US010814631B2

(12) United States Patent
Hoover et al.

(10) Patent No.: US 10,814,631 B2
(45) Date of Patent: Oct. 27, 2020

(54) INKJET PRINTHEAD CAP HAVING ROTATABLE PANELS

(71) Applicant: Xerox Corporation, Norwalk, CT (US)

(72) Inventors: Linn C. Hoover, Webster, NY (US); Jason M. LeFevre, Penfield, NY (US); Douglas K. Herrmann, Webster, NY (US); Chu-heng Liu, Penfield, NY (US); Paul J. McConville, Webster, NY (US); David A. VanKouwenberg, Avon, NY (US); Seemit Praharaj, Webster, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,094

(22) Filed: Feb. 11, 2019

(65) Prior Publication Data

US 2020/0254766 A1 Aug. 13, 2020

(51) Int. Cl.
*B41J 2/165* (2006.01)

(52) U.S. Cl.
CPC ..... *B41J 2/16505* (2013.01); *B41J 2/16552* (2013.01); *B41J 2/16547* (2013.01); *B41J 2002/16502* (2013.01); *B41J 2002/16576* (2013.01)

(58) Field of Classification Search
CPC ..... B41J 2/16505; B41J 2/16552; B41J 2002/16576; B41J 2002/16502; B41J 2/16547
See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori et al. |
| 4,571,601 | A | 2/1986 | Teshima |
| 4,746,938 | A | 5/1988 | Yamamori et al. |
| 4,947,187 | A | 8/1990 | Iwagami |
| 5,300,958 | A | 4/1994 | Burke et al. |
| 5,394,178 | A | 2/1995 | Grange |
| 5,412,411 | A | 5/1995 | Anderson |
| 5,635,965 | A | 6/1997 | Purwins et al. |

(Continued)

FOREIGN PATENT DOCUMENTS

| | | | |
|---|---|---|---|
| DE | 102011002727 | A1 | 7/2012 |
| EP | 1 827 839 | B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

*Primary Examiner* — Justin Seo
(74) *Attorney, Agent, or Firm* — Gibb & Riley, LLC

(57) ABSTRACT

Ink stabilizing material is applied to rotatable panels within a cap of an inkjet cartridge resting structure. The rotatable panels then rotate to contact an inkjet printhead when the printhead contacts the cap. Continuous periodic flushing of the printhead is performed while the rotatable panels are contacting the printhead by periodically and repeatedly alternating between ejecting a mixture of the ink stabilizing material and ink from the nozzles, and drawing the mixture of the ink stabilizing material and the ink back into the nozzles.

17 Claims, 9 Drawing Sheets

(56) References Cited

U.S. PATENT DOCUMENTS

| | | | |
|---|---|---|---|
| 5,663,751 | A | 9/1997 | Holbrook |
| 5,670,997 | A | 9/1997 | Sugimoto et al. |
| 5,726,692 | A | 3/1998 | Yamaguchi et al. |
| 5,936,647 | A | 8/1999 | Rhodes et al. |
| 5,949,448 | A | 9/1999 | Man et al. |
| 5,980,622 | A | 11/1999 | Byers |
| 6,106,098 | A | 8/2000 | Nakamura et al. |
| 6,135,585 | A | 10/2000 | Johnson et al. |
| 6,508,533 | B2 | 1/2003 | Tsujimoto et al. |
| 6,578,947 | B1 | 6/2003 | Suwabe et al. |
| 6,726,304 | B2 | 4/2004 | Fassler et al. |
| 7,156,514 | B2 | 1/2007 | Rosa |
| 7,753,475 | B2 | 7/2010 | Berry et al. |
| 7,810,899 | B2 | 10/2010 | Usui et al. |
| 7,992,986 | B2 | 8/2011 | Snyder et al. |
| 8,592,503 | B2 | 11/2013 | Bogale et al. |
| 2001/0026299 | A1 | 10/2001 | Tsujimoto et al. |
| 2002/0180853 | A1 | 12/2002 | Ohsawa et al. |
| 2003/0227505 | A1 | 12/2003 | Tanaka et al. |
| 2003/0231222 | A1 | 12/2003 | Jefferson et al. |
| 2004/0183879 | A1 | 9/2004 | Nakazawa |
| 2006/0119645 | A1 | 6/2006 | Berry et al. |
| 2006/0164460 | A1 | 7/2006 | Uwagaki et al. |
| 2007/0046721 | A1 | 3/2007 | Miyazawa |
| 2007/0076045 | A1 | 4/2007 | James et al. |
| 2007/0085875 | A1 | 4/2007 | Shimazaki et al. |
| 2007/0252863 | A1 | 11/2007 | Sun et al. |
| 2007/0263026 | A1 | 11/2007 | Shang et al. |
| 2008/0018677 | A1 | 1/2008 | White et al. |
| 2008/0024532 | A1 | 1/2008 | Kim |
| 2008/0204501 | A1 | 8/2008 | Kurita et al. |
| 2009/0174748 | A1 | 7/2009 | Balcan et al. |
| 2009/0237424 | A1 | 9/2009 | Martin et al. |
| 2010/0073445 | A1 | 3/2010 | Silverbrook et al. |
| 2011/0080443 | A1* | 4/2011 | Teramae ..... B41J 2/04551 347/10 |
| 2012/0162311 | A1 | 6/2012 | Taira |
| 2013/0215189 | A1 | 8/2013 | Justice et al. |
| 2014/0253633 | A1 | 9/2014 | Kobayashi et al. |
| 2017/0072720 | A1 | 3/2017 | Yamagishi |
| 2017/0203573 | A1 | 7/2017 | Hiramoto |
| 2018/0079217 | A1* | 3/2018 | Hiratsuka ..... B41J 2/16508 |
| 2018/0244048 | A1 | 8/2018 | Ito |
| 2018/0311986 | A1 | 11/2018 | Moriyama |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

* cited by examiner

INKJET PRINTHEAD CAP HAVING ROTATABLE PANELS

BACKGROUND

Systems and methods herein generally relate to inkjet printers and more particularly inkjet printhead caps having rotatable panels that allows periodic printhead jet flushing while printheads are capped with the panels.

Inkjet printers eject drops of liquid marking material (e.g., ink) from nozzles or "jets" of printheads in patterns to perform printing. These nozzles of the inkjet printheads routinely clog when such are unused for extended periods, for example when an inkjet printer does not print for an extended period, or when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). If the condition goes uncorrected, it can lead to intermittent firing and the jet can eventually cease firing, and such a situation can be unrecoverable resulting in irreversible printhead damage. Depending on the pre-condition of the head, the time scale for onset of such unrecoverable failure could range from a few hours to an overnight/weekend idle time.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

In order to address such issues, exemplary apparatuses herein include, among other components, a printhead that includes nozzles that are adapted to eject liquid ink. Structures herein also include a printhead resting/storage structure that is positioned to contact the printhead when the printhead is not ejecting the liquid ink. The printhead resting structure has a cap in which the printhead is parked when not printing.

With structures herein, the cap includes one or more rotatable panels that are connected to (hinged at) the top of the cap. Also, one or more nozzle contact pads (e.g., a flexible layer, foam pad, etc.) are on or connected to the rotatable panels. The rotatable panels are positioned to rotate to move the nozzle contact pads to contact the nozzles when the printhead contacts the cap, where rotation of the rotatable panels is caused by the printhead contacting the rotatable panels. The rotatable panels/nozzle contact pads can therefore be considered as an integral component of the cap (or as separate components that are connected to the cap). Also, a dispenser is positioned to dispense an ink stabilizing material on the nozzle contact pads when the printhead is not contacting the cap, and a drain is located at the bottom of the cap (e.g., distal to the top of the cap, where the printhead contacts the cap).

In greater detail, the rotatable panels each include an internal section that is positioned within the cap and an external section that extends outside the cap. The external section is positioned such that rotation of the rotatable panels is caused by the printhead contacting the external sections of the rotatable panels. More specifically, the printhead includes a nozzle plate containing the nozzles, and the rotatable panels and the nozzle contact pads are parallel to the nozzle plate when the printhead contacts the cap. Structurally, hinges connect the rotatable panels to the cap. The rotatable panels are connected to the hinges at a non-centered location along the rotatable panels to cause the rotatable panels to rest in the cap when the printhead is not contacting the rotatable panels.

Various methods herein can be adapted to periodically flush the printhead at different intervals for different color printheads or printheads using different types of inks; periodically flush the printhead only after an idle time period (during which the nozzles do not eject the liquid ink) has expired, which can be different for different colors or types of inks; etc. Thus, at the appropriate time, the methods herein dispense the ink stabilizing material from the dispenser on to the nozzle contact pads at some time when the printhead is not contacting the cap (e.g., before the printhead is to be parked on the cap for an extended period).

Once the ink stabilizing material has been applied to the nozzle contact pads, methods herein contact the printhead with the cap (when nozzles of the printhead are not ejecting liquid ink). The rotatable panels are positioned to rotate to move the nozzle contact pads to contact the nozzles when the printhead contacts the cap, where contacting the printhead to the rotatable panels moves the nozzle contact pads to contact the nozzles. Again, the rotatable panels include an internal section that is positioned within the cap and an external section that extends outside the cap, and the process of contacting the printhead contacts the printhead to the external section to rotate the rotatable panels to move the nozzle contact pads to contact the nozzles. This rotates the rotatable panels to position the rotatable panels and the nozzle contact pads parallel to the nozzle plate when the printhead contacts the cap.

With the printhead on the cap and the nozzle contact pads contacting the nozzle plate and the nozzles, methods herein allow continuous periodic flushing of the printhead by periodically alternating between: ejecting a mixture of the ink stabilizing material and the ink from the nozzles; and drawing the mixture of the ink stabilizing material and the ink into the nozzles.

Specifically, with the ink stabilizing material on the rotatable panels and the nozzles contacting the rotatable panels, ink is ejected from the nozzles to cause the ink to mix with the ink stabilizing material and form continuous film mixture. After expiration of a first time period, this processing then draws the ink and stabilizing material mixture back into the nozzles and keeps the ink and stabilizing material mixture in the ends of the nozzles for a second time period. After the second time period has expired, the nozzles once again eject the ink/stabilizing material mixture with additional ink on the rotatable panels and the process repeats. The ink/stabilizing material mixture is raised and lowered in the nozzles in this way (with pause periods between raising and lowering) periodically to draw the ink stabilizing material into and out of the nozzles continuously over the printhead storage period.

Any excess ink/stabilizing material mixture that flows off the rotatable panels will drain into the cap. When the printhead is uncapped for printing, the rotatable panels drop into the cap and the ink/stabilizing material mixture is rinsed off the rotatable panels during the printhead purge and wipe, or the capping station can pass under a wash station that rinses the rotatable panels with more ink stabilizing material, which re-forms the ink stabilizing material film on the panels so that they are ready for the next printhead storage.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, nozzles of inkjet printheads routinely clog when such are unused for extended periods, and purge and cleaning cycles are not completely effective at preventing clogs. In view of such issues, apparatuses herein provide inkjet printhead caps having rotatable panels that allows continuous printhead jet flushing while printheads are capped by the panels.

More specifically, structures herein cap the printheads with self-actuating rotatable panels (such as plastic shutters) located inside the capping station. More specifically, the printheads are mounted on a print bar that raises and lowers the printheads for capping, cleaning, and docking with the marking transport during printing. The rotatable panels are hinged along the axis of the capping station with tabs that protrude outside the station. When the print bar contacts the tabs, the rotatable panels rotate to directly contact the printhead faceplate as the printhead seals against the capping station. One of the tabs is longer than the other so that one rotatable panel begins to lift before the other, where the rotatable panels eventually overlap and form a continuous seal against the printhead faceplate.

In processing herein, the rotatable panels are rinsed with any form of ink stabilizing material (e.g., cleaning fluid, water, solvent, etc.) appropriate to the ink used in the printhead prior to capping the printhead. A thin film of this ink stabilizing material remains on the rotatable panels and forms a fluidic seal between the rotatable panels and printhead faceplate when the printhead is capped.

After the printhead is capped, the printhead is purged or the nozzles are actuated to release a small amount of ink from the nozzles into the film of ink stabilizing material trapped between the rotatable panels and printhead faceplate to ensure a continuous film of fluid. The printhead meniscus vacuum is then increased to draw the mixture of ink stabilizing material and ink into the nozzles. After a period of time, the meniscus vacuum is lowered to purge the cleaning fluid and a small volume of ink from the nozzles back between the rotatable panels and faceplate. The meniscus vacuum is raised and lowered in this way periodically to draw the cleaning fluid into and out of the nozzles in a continuous periodic process over the printhead storage period.

Any excess ink that is purged from the printhead and mixes with the cleaning fluid can flow off the rotatable panels and into the cap. When the printhead is uncapped for printing, the rotatable panels drop into the capping station and the mixture of cleaning fluid and ink is rinsed off during the printhead purge and wipe, or the capping station can pass under a wash station that rinses the rotatable panels with cleaning fluid, which re-forms the ink stabilizing material film on the panels.

Figure 1:
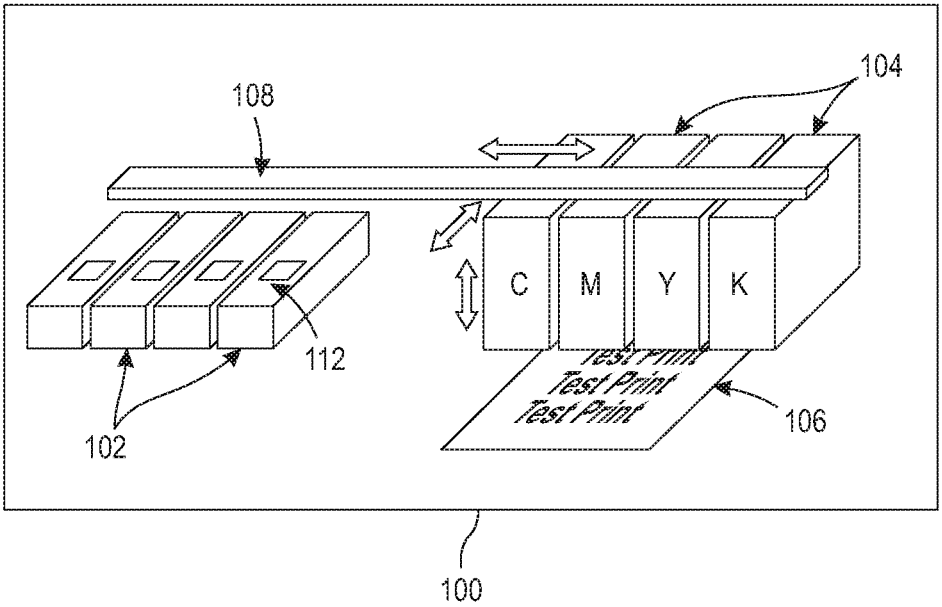
FIGS. 1 and 2 are perspective/exploded conceptual diagrams illustrating inkjet print cartridges and cartridge resting locations of structures herein.
Figure 2:
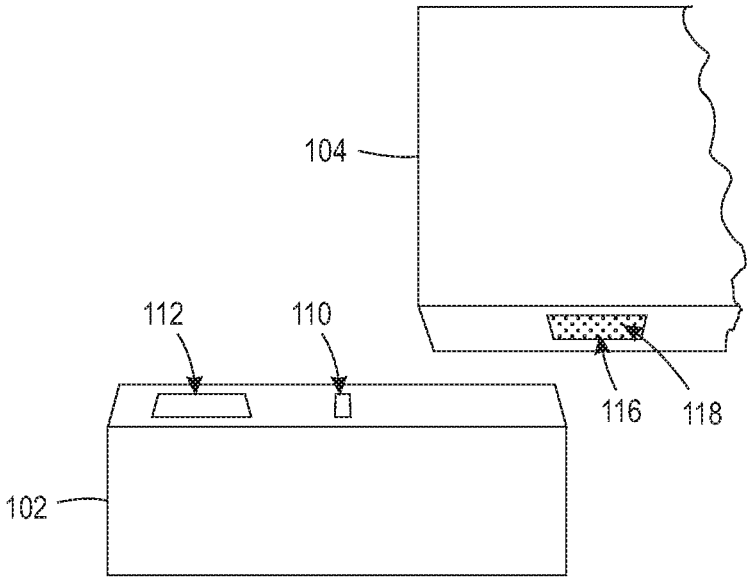

FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 108. In one example, the inkjet printer cartridges 104 are moved by the actuator/track structure 108 into a printing location to print markings on a sheet of print media 106. When not printing, the inkjet print cartridges 104 move to a "parked," "resting," or "home" position where they connect to a cap or drip tray 112 of the cartridge resting structures 102. Note, as shown by the block arrows in FIG. 1, the actuator/track structure 108 can move the inkjet print cartridges 104 and/or cartridge resting structures 102 in many different directions.

The inkjet print cartridges 104 remain connected to the cartridge resting structures 102 unless the inkjet printing engine 100 is in the process of using the inkjet print cartridges 104 for printing. When printing markings on the sheet of print media 106, the inkjet printers 100 eject drops (droplets) of liquid marking material (e.g., ink, etc.) from nozzles 118 (jets) of inkjet printheads 116 in patterns to perform the printing on the print media 106. After printing, the inkjet print cartridges 104 again return to the cartridge resting structures 102.

As shown in FIG. 2, cartridge resting structures 102 can include a wiper 110. The wiper can be, for example, a flexible blade, foam pad, roller, etc. When an inkjet print cartridge 104 is moving relative to a cartridge resting structure 102, the actuator/track structure 108 can move the inkjet printheads 116 to contact the wiper 110 so that the wiper 110 can wipe fluids, materials, debris, etc., off the inkjet printheads 116.

Again, the nozzles 118 of such inkjet printheads routinely clog when such are unused for extended periods. In order to address such issues, apparatuses herein include one or more asymmetric rotatable panels 120, 122 that are connected to the top of the cap 112, as shown in cross-sectional view in FIG. 3. Also, FIG. 3 illustrates one or more nozzle contact pads 124 (e.g., a flexible layer, foam pad, etc.) that can optionally be positioned on and connected to the rotatable panels 120, 122.

Figure 3:
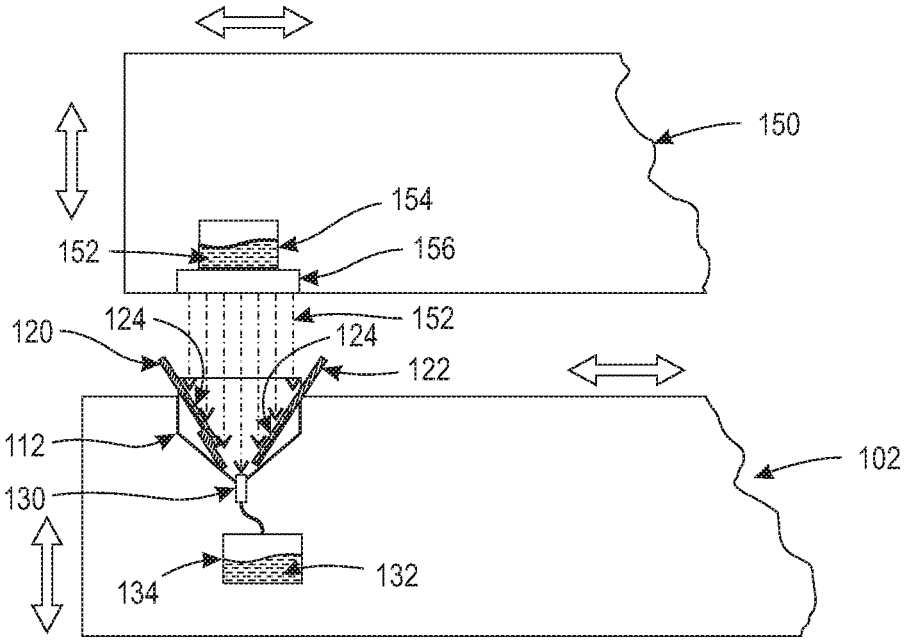
FIGS. 3-5B are cross-sectional conceptual diagrams structures herein.

As additionally shown in FIG. 3, a drain 130 can be connected to the bottom of the cap 112. Note that the terms "bottom" and "top" are arbitrary, and that the top of the cap 112 is the portion of the cap 112 that makes contact with the printhead 116, while the bottom of cap 112 is opposite (distal to) the top. The drain 130 can be connected to a waste reservoir 134 that maintains waste materials/liquids 132 drained from the cap 112.

FIG. 3 also illustrates a wash station 150 that is movable relative to the cartridge resting structure 102. The wash station 150 includes a wash reservoir 154 that maintains what is referred to herein as an ink stabilizing material 152. The ink stabilizing material 152 can be any material (liquid, gel, powder, etc.) that has the ability to keep liquid ink from drying. For example, the ink stabilizing material 152 can be water, cleaning solution (with or without detergents), solvents, co-solvents, ink (with or without pigments), etc., or any combination of such materials. The ink stabilizing material 152 is dispensed through a dispenser 156. As shown in FIG. 3, the rotatable panels 120, 122 (and optional nozzle contact pads 124, if so equipped) can be rinsed or washed through application (drip or high pressure jetting) of the ink stabilizer material 152 into the cap 112. Any excess amounts of the ink stabilizing material 152 drains into the waste reservoir 134.

Figure 4:
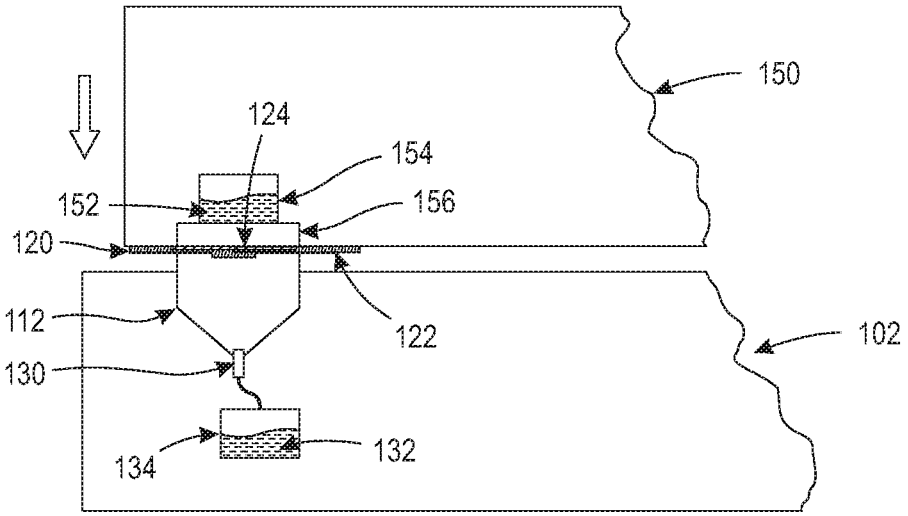

FIG. 4 illustrates an alternative arrangement where the wash station 150 physically contacts the cartridge resting structure 102 when dispensing the ink stabilizing material 152 to potentially provide more effective cleaning of the rotatable panels 120, 122 and optional nozzle contact pads 124. Note that as shown in FIG. 4, the rotatable panels 120, 122 rotate to be parallel with the surface of the dispenser 156 when the wash station 150 makes contact with the cartridge resting structure 102.

Figure 5A:
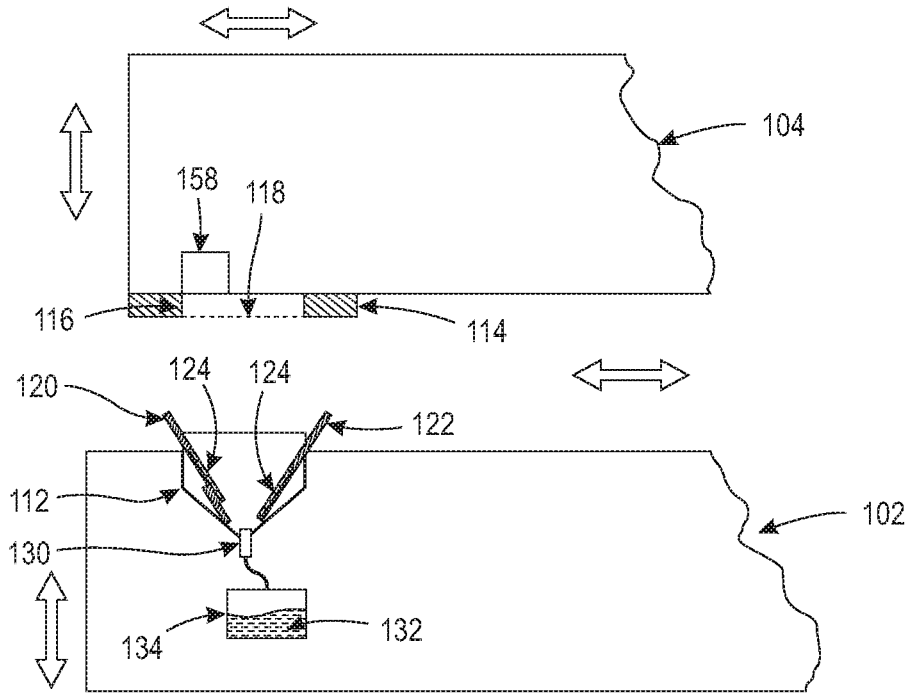
Figure 5B:
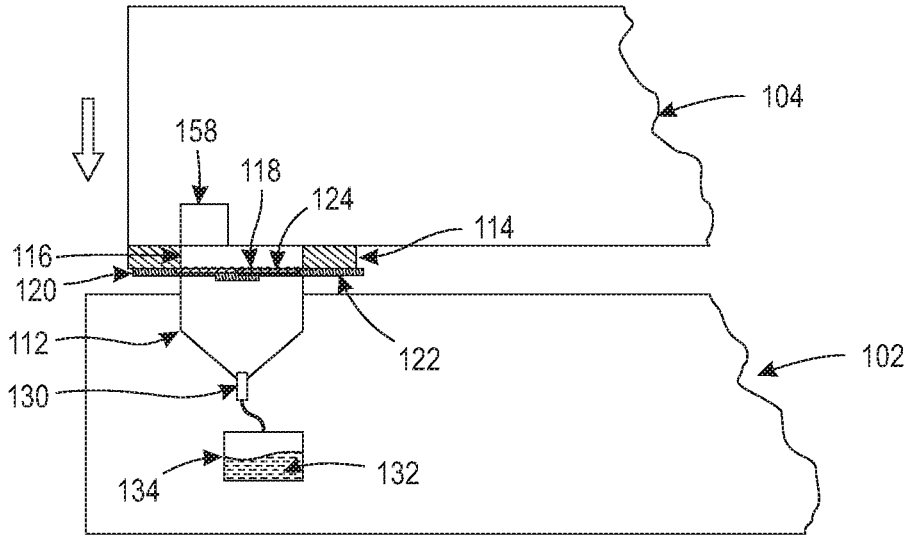

FIGS. 5A-5B illustrate the inkjet print cartridge 104 and the cartridge resting structure 102 being moved (FIG. 5A) relative to one another (e.g., by the actuator/track structure 108 discussed above) to cause printhead 116 to contact and rest on the cap 112 (FIG. 5B). Again, as noted above, the rotatable panels 120, 122 rotate to be parallel with the surface of the printhead 116 when a print bar 114 of the inkjet print cartridge 104 makes contact with the cartridge resting structure 102. For purposes herein the print bar 114 is considered a component of the printhead 116, but the same could be separate components. FIGS. 5A-5B also illustrate a meniscus control 158 that has internal components (pumps, actuators etc.) that apply pressure/vacuum to the nozzles 118 to move ink within the nozzles 118.

Figure 6A:
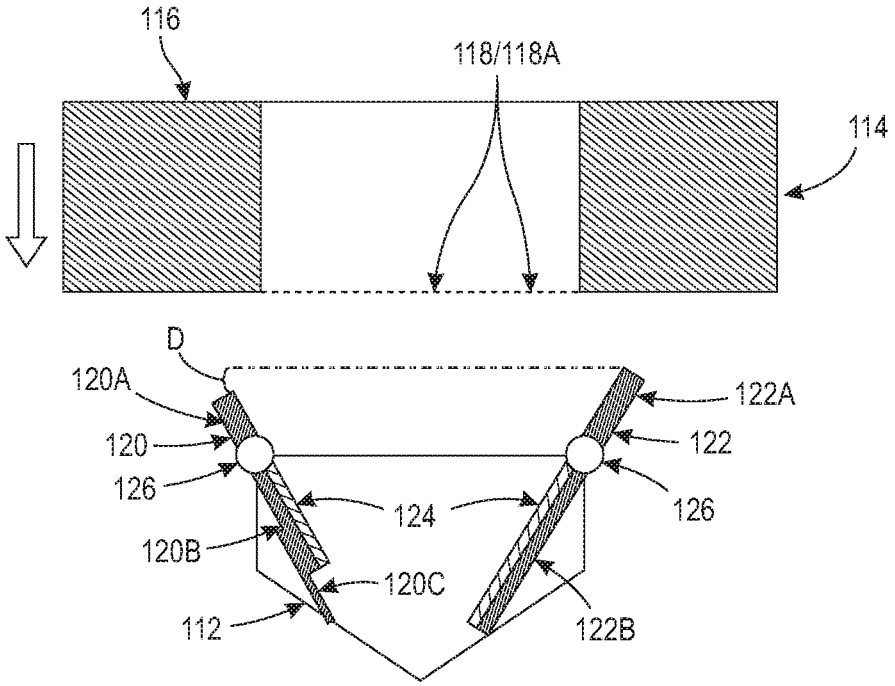
FIGS. 6A-7 are enlarged cross-sectional conceptual diagrams illustrating an inkjet print cartridge and a cartridge resting location of structures herein.
Figure 6B:
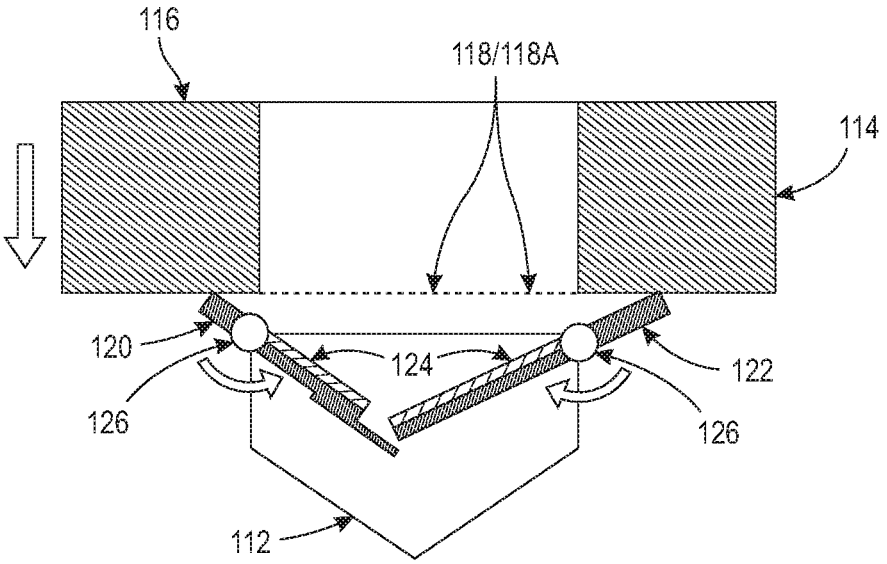
Figure 6C:
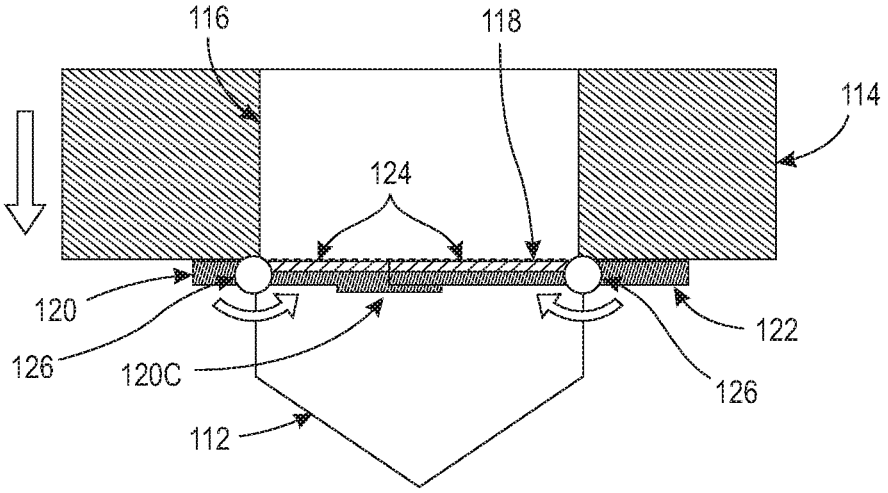

This is shown in greater detail in the expanded cross-sectional views presented in FIGS. 6A-6C. Thus, FIGS. 6A-6C show a succession of movements where the rotatable panels 120, 122 are positioned to rotate (to potentially move the optional nozzle contact pads 124) to contact the nozzles 118 when the printhead 116 contacts the cap 112, where rotation of the rotatable panels 120, 122 is caused by the printhead 116 (or the printhead's print bar 114) contacting the rotatable panels 120, 122.

The rotatable panels 120, 122 are formed of any material (such as plastics, polymers, metals, alloys, ceramics, fiber materials, etc.) that has sufficient stiffness/rigidity to retain the existing shape (avoid excessive deformation) when rotated into position to contact the cartridge resting structure 102 and/or wash station 150. The optional nozzle contact pads 124 are more flexible (have a greater elasticity measure) relative to the rotatable panels 120, 122. The more compliant, more flexible nozzle contact pads 124 increase the surface area contact with the printhead 116 and nozzles 118 and helps the mixture of ink stabilizing material 152 and ink form a fluidic seal at the ends of the nozzles 118 to prevent the ink in the nozzles 118 from drying.

Structurally, hinges 126 connect the rotatable panels 120, 122 to the top of the cap 112. Therefore, the rotatable panels 120, 122/nozzle contact pads 124 can therefore be considered as an integral component of the cap 112 (or as separate components that are connected to the cap 112).

In greater detail, the rotatable panels 120, 122 each include an external section (sometimes referred to as a tab) 120A, 122A that extends outside the cap 112 and an internal section 120B, 122B that is positioned within the cap 112. Additionally, one of the rotatable panels 120 can optionally include the third section 120C that has a reduced thickness relative to the other sections. Note that many of such identification numerals are omitted from FIGS. 6B-6C to avoid clutter in the drawings.

As can be seen in FIGS. 6B-6C, when the panels are rotated, the thinner third section 120C overlaps the opposing rotatable panel 122 to provide additional structural support to keep the rotatable panels 120, 122 parallel to the bottom surface of the printhead 116. More specifically, the printhead 116 includes a nozzle plate 118A containing the nozzles (both of which are in the same location in FIGS. 6A-6C, but are shown separately in FIG. 7), and the rotatable panels 120, 122 and the nozzle contact pads 124 are parallel to the nozzle plate 118A when the printhead 116 contacts the cap 112, as shown in FIG. 6C.

As shown in FIG. 6A, the rotatable panels 120, 122 are connected to the hinges 126 at non-centered locations along the rotatable panels 120, 122 to cause the rotatable panels 120, 122 to rest in the cap 112 when the printhead 116 is not contacting the rotatable panels 120, 122. In other words, the internal sections 120B, 122B are longer (or at least heavier) than the external sections 120A, 122A, causing the rotatable panels 120, 122 to rest in the cap 112 when the printhead 116 is not contacting the rotatable panels 120, 122.

As shown in FIG. 6B, the external sections 120A, 122A are positioned such that rotation of the rotatable panels 120, 122 is caused by the printhead 116 contacting the external sections of the rotatable panels 120, 122. Further, the rotatable panels 120, 122 are different lengths (asymmetric) helping promote proper overlap. This can be seen in FIG. 6A where the external section 120A of one rotatable panel 120 is shorter than the external section 122A of the other rotatable panel 122.

This causes the end of one rotatable panel 120 to sit lower (e.g., by distance D) than the other rotatable panel 122, as shown in FIG. 6A. This results in the longer rotatable panel 122 contacting print bar 114 of the inkjet printhead 116 before the shorter rotatable panel 120, which causes the longer rotatable panel 122 to begin rotating before the shorter rotatable panel 120, resulting in the longer rotatable panel 122 overlapping over the shorter rotatable panel 120, as shown in FIG. 6B.

Figure 7:
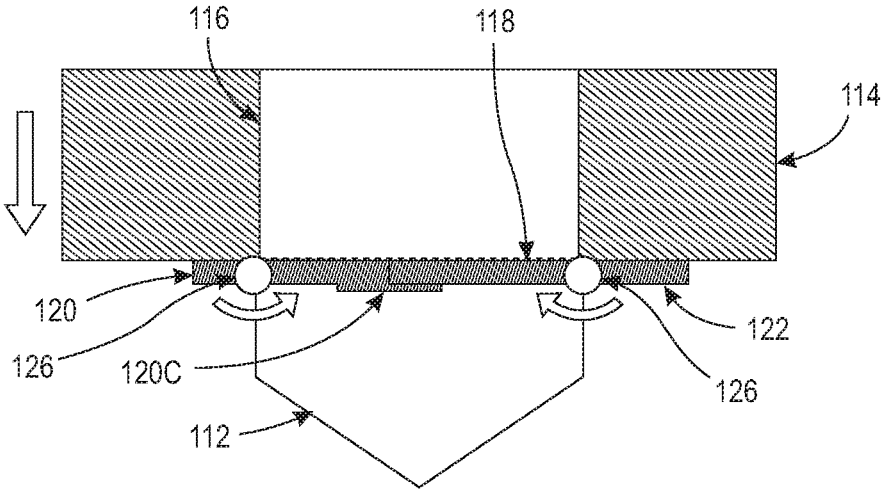

This rotation continues as the inkjet printhead 116 moves into full contact with the cap 112, which results in the surfaces of the rotatable panels 120, 122 (and the surfaces of the optional nozzle contact pads 124) being parallel to the bottom of the inkjet printhead 116 (parallel to the bottom of the nozzle plate 118A), as shown in FIG. 6C. Also note that the third section 120C of one of the rotatable panels 120 is shown as resting under (contacting) and supporting the end of the other rotatable panel 122 in FIG. 6C. FIG. 7 shows the structures in the same position as is shown in FIG. 6C; however, FIG. 7 shows the structures without the optional nozzle contact pad 124.

Figure 8:
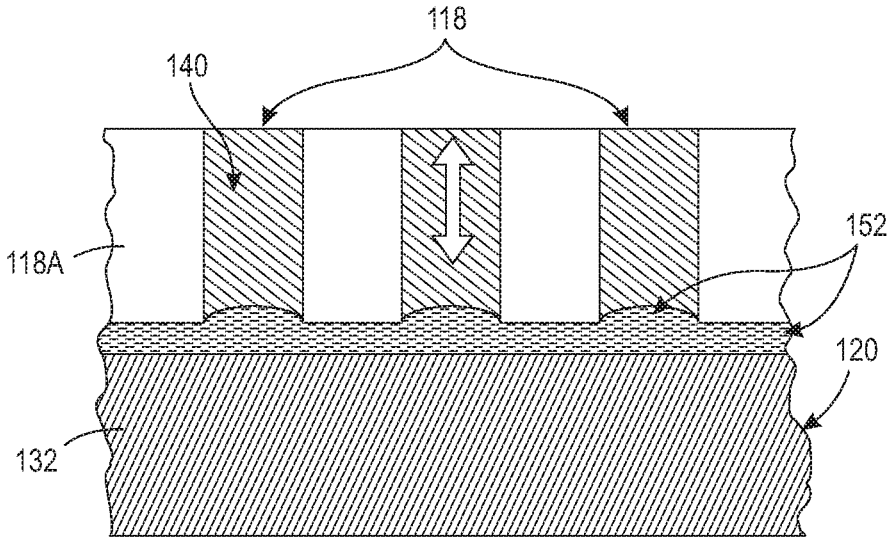
FIGS. 8-9 are enlarged cross-sectional views of a cap device and printhead of structures herein.
Figure 9:
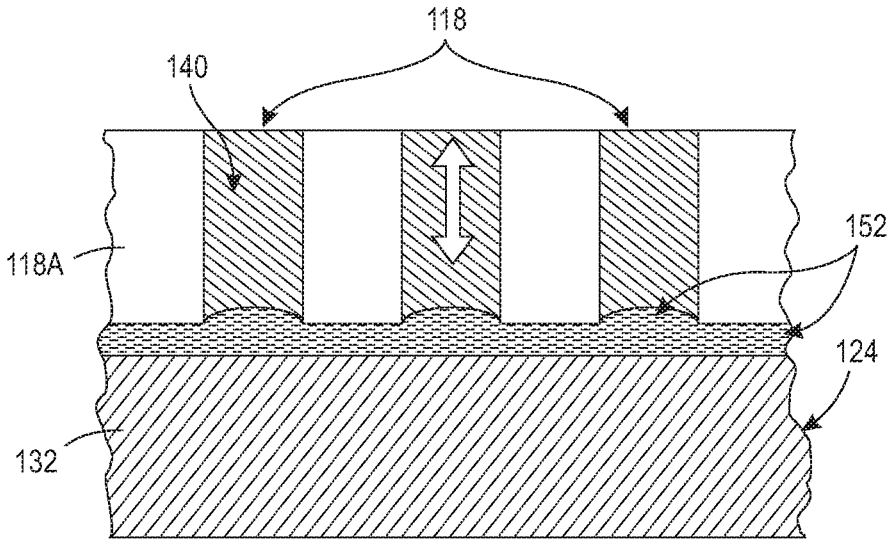

FIG. 8 is a cross-sectional view of a small portion of the nozzle plate 118A and shows a few of the nozzles 118 with liquid ink 140 therein. As discussed above with reference to FIGS. 3 and 4, the rotatable panels 120, 122 are rinsed with the ink stabilizing material 152, and some of the ink stabilizing material 152 remains on the rotatable panels 120, 122. Therefore, when the rotatable panels 120, 122 are rotated to be parallel to the nozzle plate 118A, the remaining film of the ink stabilizing material 152 stays between the rotatable panel 120 and the nozzle plate 118A. Thus, the thin film of this ink stabilizing material 152 remains on the rotatable panels 120, 122 and forms a fluidic seal between the rotatable panels 120, 122 and the bottom of the nozzle plate 118A when the printhead 116 is capped with the cap 112. FIG. 9 shows the same as FIG. 8, but with the optional nozzle contact pad 124 in place.

The meniscus control 158 (FIGS. 5A-5B) is adapted to periodically push some ink 140 out of the nozzles 118 (which causes the ink 140 to mix with the ink stabilizing material 152) and later periodically draw some of the mixture of ink 140 and ink stabilizing material back into the ends of the nozzles 118 while the inkjet printhead 116 is stored on the cap 112.

This allows the meniscus control 158 to be controlled to periodically flush the printhead 116, continuously during the printhead storage period. This continuous process periodically flushes the nozzles 118 by alternating between ejecting the ink 140 from the nozzles 118 and drawing the mixture of the ink stabilizing material 152 and the ink 140 back into the nozzles 118. Specifically, with the ink stabilizing material 152 on the rotatable panels 120, 122 and the nozzles 118 contacting the rotatable panels 120, 122, ink 140 is ejected from the nozzles 118 to cause the ink 140 to mix with the ink stabilizing material 152 and form continuous film mixture 140/152. After a first time period has expired, this processing then draws the ink 140 and stabilizing material 152 mixture back into the nozzles 118 and keeps the ink 140 and stabilizing material 152 mixture in the ends of the nozzles 118 for a second time period. After the second time period has expired, the nozzles 118 once again eject the ink 140/stabilizing material 152 mixture with additional ink 140 on the rotatable panels 120, 122 and the process continually repeats until the printhead 116 is needed for printing.

Thus, the ink 140/stabilizing material 152 mixture is raised and lowered in the nozzles 118 in this way periodically to draw the ink stabilizing material 152 into and out of the nozzles 118 continuously over the printhead 116 storage period. During such processing, additional ink 140 will be added to the ink/stabilizing material mixture 140/152 that is between the rotatable panels 120, 122 and the bottom of the nozzle plate 118A. Any excess ink 140/stabilizing material 152 mixture that flows off the rotatable panels 120, 122 will drain into the cap 112. Further, once a sufficient amount of ink 140 has been added to the ink/stabilizing material mixture 140/152, and the ink/stabilizing material mixture 140/152 will be diluted of ink stabilizing material mixture 152, and then the cartridge resting structure 102 can be returned to the wash station 150 (see FIG. 3) to receive a fresh layer of ink stabilizing material 152. Thus, the wash station 150 can again rinse the rotatable panels 120, 122 with more ink stabilizing material 152 and re-form the ink stabilizing material 152 film on the panels 120, 122. After this, the printhead 116 returns to the cap 112, where the periodic flushing is continued.

Figure 10:
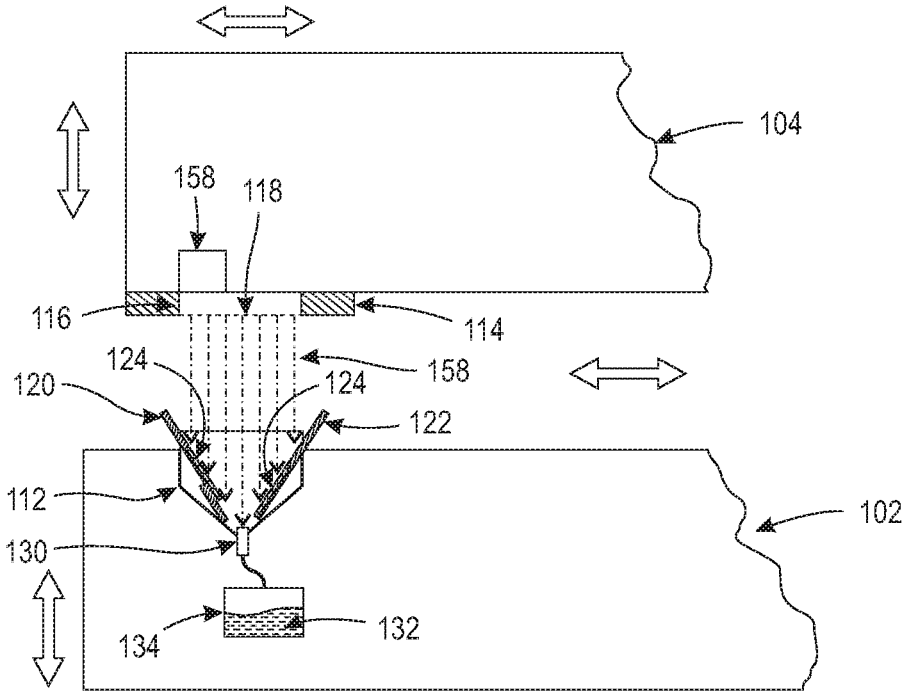
FIG. 10 is a cross-sectional conceptual diagrams illustrating an inkjet print cartridge and a cartridge resting location of structures herein.

When the printhead 116 is uncapped from the cap 112 for printing (shown in FIG. 10), the rotatable panels 120, 122 drop into the cap 112. As shown in FIG. 10, the nozzles can be purged using a purging/cleaning solution 158. As also shown in FIG. 10, if the purging process is performed over the cap 112, the ink/stabilizing material mixture 140/152 can be rinsed off the rotatable panels 120, 122 by the purging cleaning solution 158 ejected through the nozzles 118 into the cap 112. Alternatively, or in addition, the cartridge resting structure 102 can be again moved to pass under the wash station 150 to rinse the rotatable panels 120, 122 with more ink stabilizing material 152 as shown in FIG. 3, to re-form the ink stabilizing material 152 film on the panels 120, 122 so that they are ready for the next printhead 116 storage.

In addition, each different meniscus control 158 in each different print cartridge 104 is adapted to periodically flush the printhead 116 at different intervals for different type inks or colors, periodically flush the printhead only after an idle time period (during which the nozzles do not eject the liquid ink) has expired, which can be different for different inks or colors, etc.

Figure 11:
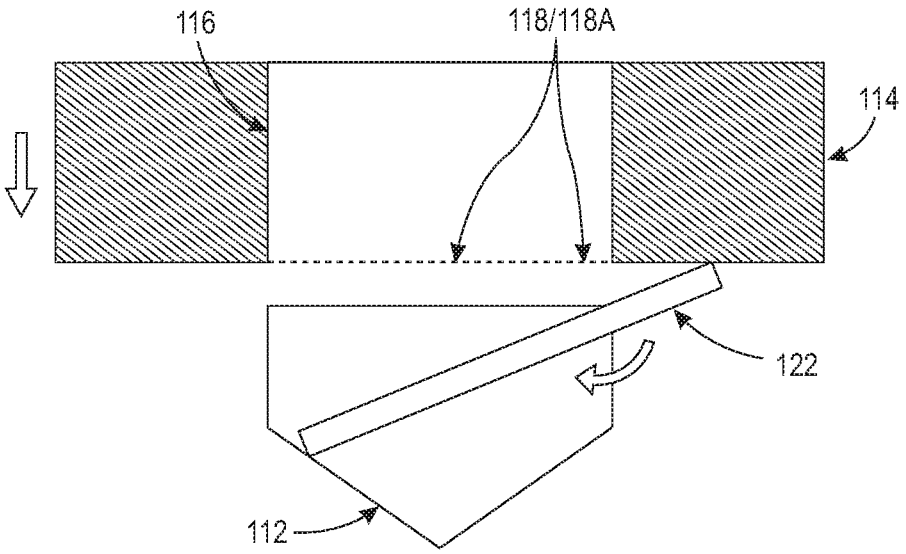
FIG. 11 is an enlarged cross-sectional conceptual diagrams illustrating an inkjet print cartridge and a cartridge resting location of structures herein.

While two rotatable panels are shown in the foregoing examples, a single rotatable panel could be used with structures herein. For example, as shown in FIG. 11, a single rotatable pane 122 is attached to the cap 112. All other features/elements are as described above.

Figure 12:
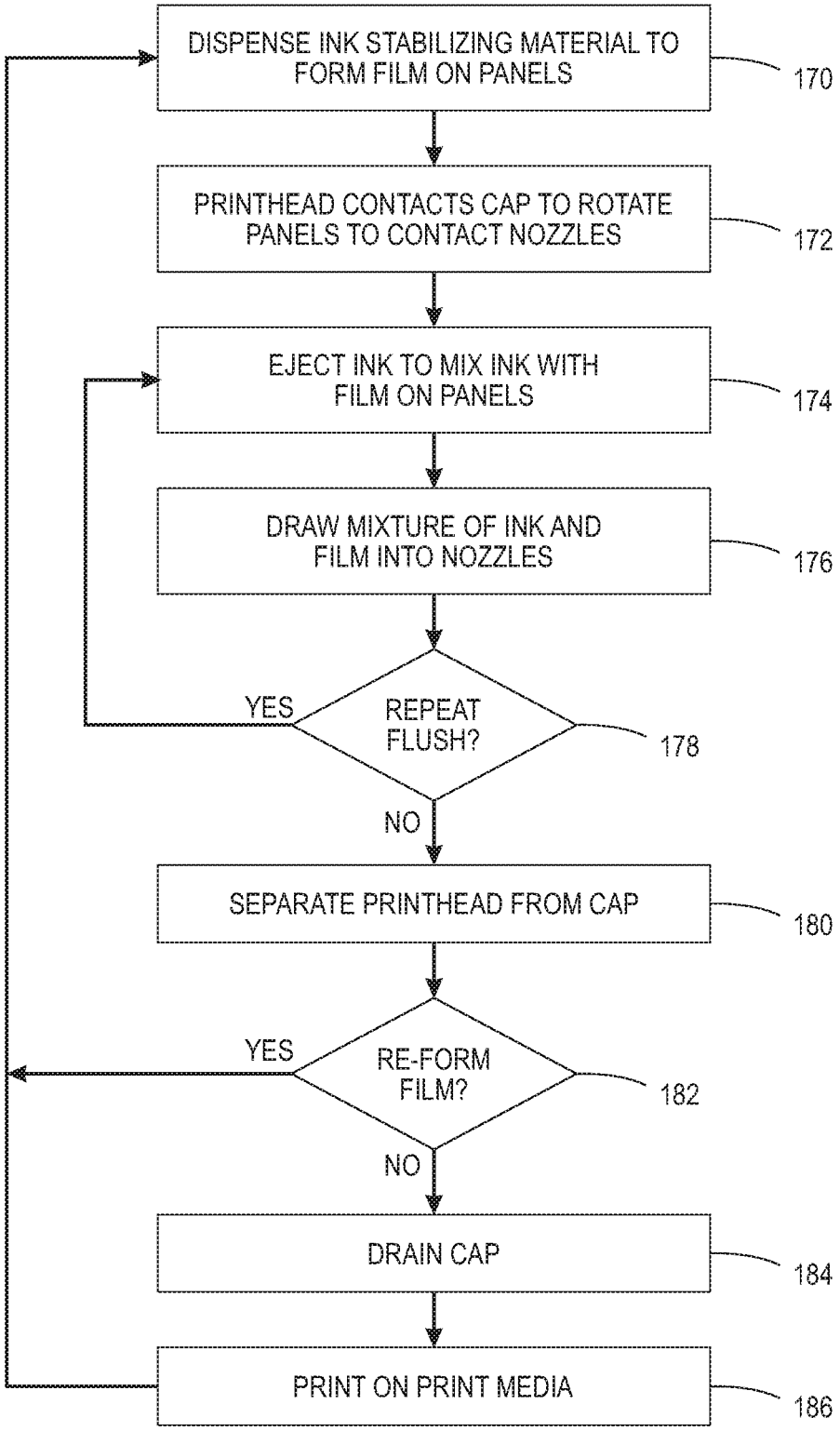
FIG. 12 is a flowchart illustrating methods herein.

FIG. 12 illustrates some aspects of various methods herein. In item 170, such methods dispense the ink stabilizing material from the dispenser on the rotatable panels (potentially having the nozzle contact pads thereon) to form the ink stabilizing film on the panels at some time when the printhead is not contacting the cap (e.g., before the printhead is to be parked on the cap for an extended period).

Once the ink stabilizing material has been applied to rotatable panels (potentially having the nozzle contact pads thereon) methods herein contact the printhead with the cap in item 172. The rotatable panels are positioned to rotate to move the nozzle contact pads to contact the nozzles when the printhead contacts the cap in item 172. If the nozzle contact pads are used, the process of contacting the printhead to the rotatable panels in item 172 moves the nozzle contact pads to contact the nozzles. Again, the rotatable panels include an internal section that is positioned within the cap and an external section that extends outside the cap, and the process of contacting the printhead contacts the printhead to the external section to rotate the rotatable panels to move the nozzle contact pads to contact the nozzles. This rotates the rotatable panels to position the rotatable panels and the nozzle contact pads parallel to the nozzle plate when the printhead contacts the cap.

With the printhead on the cap and the nozzle contact pads contacting the nozzle plate and the nozzles, methods herein flush the printhead in items 174-178 in a continuous process by periodically alternating between: ejecting a mixture of the ink stabilizing material and the ink from the nozzles 174; drawing the mixture of the ink stabilizing material and the ink back into the nozzles 176; and repeating such flush processing 178 until more ink stabilizing material is applied (182-170), or until printing is to resume (186).

Specifically, with the ink stabilizing material on the rotatable panels and the nozzles contacting the rotatable panels, ink is ejected from the nozzles to cause the ink to mix with the ink stabilizing material and form continuous film mixture of ink and ink stabilizing material in item 174. This processing then draws the ink and stabilizing material mixture back into the nozzles and keeps the ink and stabilizing material mixture in the ends of the nozzles for an established time period in item 176. After the time period has expired, the nozzles once again eject the ink/stabilizing material mixture with additional ink on the rotatable panels (processing in item 178 causes processing in item 174 to be repeated). The ink/stabilizing material mixture is raised (174) and lowered (176) in the nozzles in this way periodically to draw the ink stabilizing material into and out of the nozzles continuously over the printhead storage period. Any excess ink/stabilizing material mixture that flows off the rotatable panels will drain into the cap.

These methods can periodically flush the printhead (174-178) at different intervals for different color printheads, or for printheads that use different types of inks; periodically flush the printhead (174-178) only after an idle time period (during which the nozzles do not eject the liquid ink) has expired, which can be different for different colors or types of inks; etc.

The printhead is uncapped in item 180, which causes the rotatable panels drop into the cap, after which a purge process clears the ink/stabilizing material mixture from the nozzles. In the purging part of uncapping in item 180, a sufficient quantity of ink is ejected from the nozzles into the cap until all the ink/stabilizing material mixture had been cleared from the nozzles and the nozzles are only ejecting ink. After purging, the nozzles are wiped with the wiper, which is included in the processing shown in item 180. If the ink stabilizing film is to be reformed on the rotatable panels, item 182 returns processing to item 170 to re-apply the ink stabilizing material and re-form the ink stabilizing film. If the film is not to be reformed, the cap can be drained in item 184 and printing can be performed in item 186 (which may include purge/wipe processing, etc., before actual printing).

Figure 13:
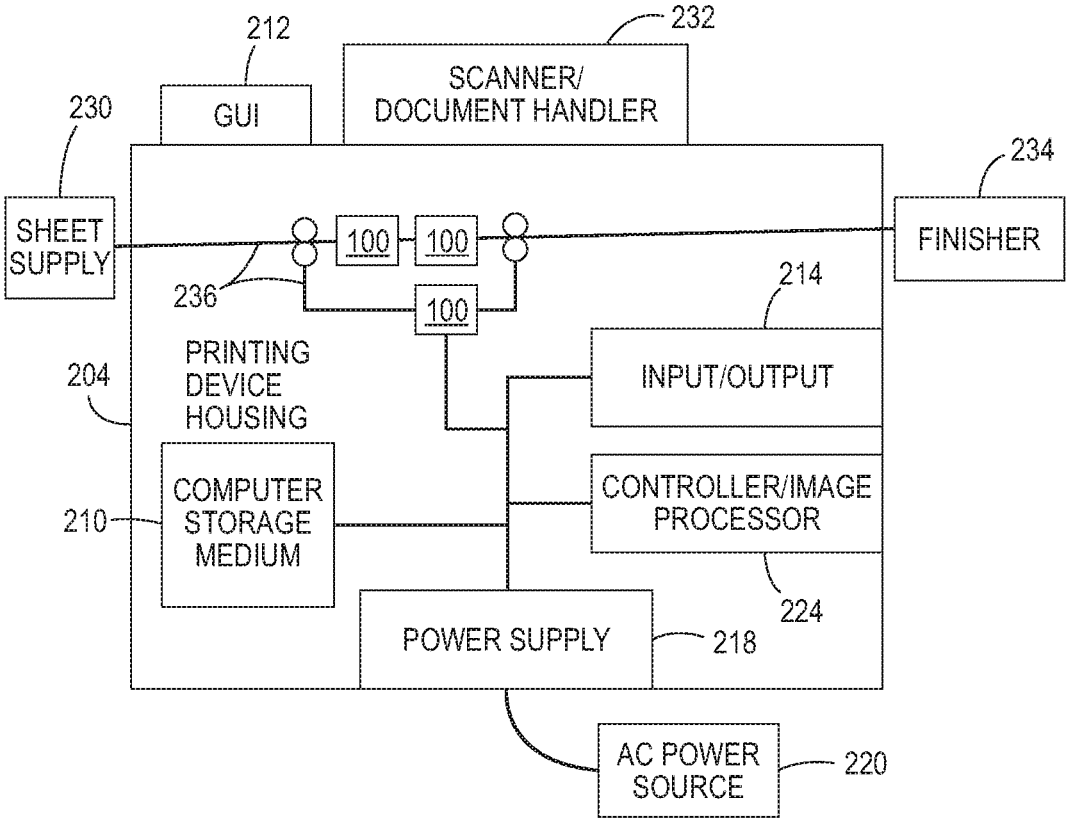
FIG. 13 is a conceptual diagram illustrating printing devices herein.

FIG. 13 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 11, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

Thus, the processor 224 can be adapted to control the meniscus control 158 to periodically flush the printhead 116 at different intervals for different color printheads or printheads using different types of inks; periodically flush the printhead 116 only after an idle time period (during which the nozzles do not eject the liquid ink) has expired, which can be different for different colors or types of inks; etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a cap positioned to contact a printhead, comprising nozzles adapted to eject liquid ink, when the printhead is not ejecting the liquid ink, wherein the cap comprises:

a rotatable panel connected to the cap; and a nozzle contact pad connected to the rotatable panel, wherein the rotatable panel is positioned to rotate to move the nozzle contact pad to contact the nozzles when the printhead contacts the rotatable panel.

2. The apparatus according to claim 1, wherein the rotatable panel include an internal section that is positioned within the cap and an external section that extends outside the cap, and wherein the external section is positioned such that rotation of the rotatable panel is caused by the printhead contacting the external section of the rotatable panel.

3. The apparatus according to claim 1, wherein the printhead includes a nozzle plate containing the nozzles, and wherein the rotatable panel and the nozzle contact pad are parallel to the nozzle plate when the printhead contacts the cap.

4. The apparatus according to claim 1, further comprising hinges connecting the rotatable panel to the cap, wherein the rotatable panel is connected to the hinges at a non-centered location along the rotatable panel to cause the rotatable panel to rest in the cap when the printhead is not contacting the rotatable panel.

5. The apparatus according to claim 1, wherein the nozzle contact pad comprises a flexible layer.

6. The apparatus according to claim 1, further comprising a drain located at a bottom of the cap distal to a top of the cap where the printhead contacts the cap.

7. An apparatus comprising:

a printhead comprising nozzles adapted to eject liquid ink;

a cap positioned to contact the printhead when the printhead is not ejecting the liquid ink, wherein the cap comprises:

a rotatable panel connected to the cap; and a nozzle contact pad connected to the rotatable panel, wherein the rotatable panel is positioned to rotate to move the nozzle contact pad to contact the nozzles when the printhead contacts the rotatable panel; and a dispenser positioned to dispense an ink stabilizing material on the nozzle contact pad when the printhead is not contacting the cap.

8. The apparatus according to claim 7, wherein the rotatable panel include an internal section that is positioned within the cap and an external section that extends outside the cap, and wherein the external section is positioned such that rotation of the rotatable panel is caused by the printhead contacting the external section of the rotatable panel.

9. The apparatus according to claim 7, wherein the printhead includes a nozzle plate containing the nozzles, and wherein the rotatable panel and the nozzle contact pad are parallel to the nozzle plate when the printhead contacts the cap.

10. The apparatus according to claim 7, further comprising hinges connecting the rotatable panel to the cap, wherein the rotatable panel is connected to the hinges at a non-centered location along the rotatable panel to cause the rotatable panel to rest in the cap when the printhead is not contacting the rotatable panel.

11. The apparatus according to claim 7, wherein the nozzle contact pad comprises a flexible layer.

12. The apparatus according to claim 7, further comprising a drain located at a bottom of the cap distal to a top of the cap where the printhead contacts the cap.

13. A method comprising:

dispensing an ink stabilizing material from a dispenser on a nozzle contact pad, wherein the nozzle contact pad is connected to a rotatable panel, and wherein the rotatable panel is a component of a cap; and contacting a printhead to the cap when nozzles of the printhead are not ejecting liquid ink, wherein the rotatable panel is positioned to rotate to move the nozzle contact pad to contact the nozzles when the printhead contacts the rotatable panel.

14. The method according to claim 13, wherein the rotatable panel includes an internal section that is positioned within the cap and an external section that extends outside the cap, and wherein the contacting the printhead comprises contacting the printhead to the external section to rotate the rotatable panel to move the nozzle contact pad to contact the nozzles.

15. The method according to claim 13, wherein the printhead includes a nozzle plate containing the nozzles, and wherein the contacting the printhead rotates the rotatable panel to position the rotatable panel and the nozzle contact pad parallel to the nozzle plate when the printhead contacts the cap.

16. The method according to claim 13, further comprising, with the nozzle contact pad contacting the nozzles, periodically flushing the nozzles.

17. The method according to claim 16, wherein the periodically flushing the nozzles comprises periodically alternating between: ejecting a mixture of the ink stabilizing material and the ink from the nozzles; and drawings the mixture of the ink stabilizing material and the ink into the nozzles.

* * * * *